US009870886B2

(12) United States Patent
Furuuchi et al.

(10) Patent No.: US 9,870,886 B2
(45) Date of Patent: Jan. 16, 2018

(54) PROTECTIVE ELEMENT AND PROTECTIVE CIRCUIT SUBSTRATE USING THE SAME

(71) Applicant: DEXERIALS CORPORATION, Tokyo (JP)

(72) Inventors: Yuji Furuuchi, Nikko (JP); Takashi Fujihata, Kanazawa (JP); Koichi Mukai, Utsunomiya (JP)

(73) Assignee: DEXERIALS CORPORATION, Tokyo (JP)

( * ) Notice: Subject to any disclaimer, the term of this patent is extended or adjusted under 35 U.S.C. 154(b) by 198 days.

(21) Appl. No.: 15/045,686

(22) Filed: Feb. 17, 2016

(65) Prior Publication Data

US 2017/0236666 A1 Aug. 17, 2017

(51) Int. Cl.
*H01H 37/34* (2006.01)
*H01H 85/02* (2006.01)

(52) U.S. Cl.
CPC ..... *H01H 37/34* (2013.01); *H01H 85/0241* (2013.01); *H01H 2085/0283* (2013.01)

(58) Field of Classification Search
CPC ..... H01H 37/34; H01H 85/00
See application file for complete search history.

(56) References Cited

U.S. PATENT DOCUMENTS 6,150,868 A * 11/2000 Kim ..... G11C 17/18 257/E23.147
9,337,671 B2 * 5/2016 Komori ..... H01M 2/34
9,401,257 B2 * 7/2016 Dietsch ..... H01H 85/0417

FOREIGN PATENT DOCUMENTS

JP 2004-185960 A 7/2004
JP 2010-003665 A 1/2010
JP 2012-003878 A 1/2012
JP 2015-035279 A 2/2015

* cited by examiner

*Primary Examiner* — Hai L Nguyen
(74) *Attorney, Agent, or Firm* — Oliff PLC

(57) ABSTRACT

A protective element includes: a rectangurarly shaped insulating substrate; a heat-generating element formed on the insulating substrate; first and second electrodes laminated on a surface of the insulating substrate; first and second connecting terminals provided on a back surface of the insulating substrate and being continuous with the first and second electrodes; a heat-generating element extracting electrode provided on a current path between the first and the second electrodes and electrically connected to the heat-generating element; and a meltable conductor laminated on a region extending from the heat-generating element extracting electrode to the first and second electrodes and to be melted by heat to interrupt the current path between the first electrode and the second electrodes; wherein at least one of the corner portions of the insulating substrate is chamfered.

9 Claims, 7 Drawing Sheets

PROTECTIVE ELEMENT AND PROTECTIVE CIRCUIT SUBSTRATE USING THE SAME

TECHNICAL FIELD

This invention relates to a protective circuit substrate including a protective element which interrupts a current path when an abnormality such as over-charging and over-discharging occurs.

BACKGROUND ART

Secondary batteries are often provided to users in the form of rechargeable battery packs which can be repeatedly used. In particular, in order to protect users and electronic appliances, lithium ion secondary batteries having a high volumetric energy density typically include several protective circuits incorporated in battery packs for over-charging protection and over-discharging protection to interrupt the output of the battery pack under predetermined conditions.

Some of these protective elements use an FET switch incorporated in a battery pack to turn ON/OFF the output, for over-charging protection or over-discharging protection of the battery pack. However, even in the cases of the FET switch being short-circuited and damaged for some reason, a large current momentarily flows caused by a surge such as a lightning surge, and an abnormally decreased output voltage or an excessively high voltage occurs in an aged battery cell, the battery pack or the electronic appliance should prevent accidents including fire, among others. For this reason, a protective element is used having a fuse which interrupts a current path in accordance with an external signal so as to safely interrupt the output of the battery cell under these possible abnormalities.

As shown in FIGS. 10 (A) and (B), there has been proposed a protective element 80 of a protective circuit for a lithium ion secondary battery in which a meltable conductor 83 is connected as a part of a current path between first and second electrodes 81, 82, and this meltable conductor 83 in the current path is blown by self-heating due to an overcurrent or by a heat-generating element 84 provided in the protective element 80.

In particular the protective element 80 includes an insulating substrate 85, a heat-generating element 84 laminated on the insulating substrate 85 and covered with an insulating member 86, a first and a second electrodes 81, 82 formed on the both ends of the insulating substrate 85, a heat-generating element extracting electrode 88 laminated on the insulating member 86 and overlapping the heat-generating element 84, and a meltable conductor 83 the both ends of which are connected to the first and second electrodes 81, 82, respectively, and the central portion of which is connected to the heat-generating element extracting electrode 88.

In the protective element 80, when an abnormality such as over-charging or over-discharging is detected, current flows through the heat-generating element 84 and the heat-generating element generates heat. The meltable conductor 83 is melted by this heat and gathers on the heat-generating element extracting electrode 88 to interrupt the current path between the first and second electrodes 81, 82.

PRIOR ART LITERATURE

Patent Literature

PLT 1: Japanese Unexamined Patent Application Publication No. 2010-003665

PLT 2: Japanese Unexamined Patent Application Publication No. 2004-185960

PLT 3: Japanese Unexamined Patent Application Publication No. 2012-003878

SUMMARY OF THE INVENTION

Technical Problem

The protective element 80 is mounted by connecting first and second connecting terminals 92, 93 formed on the back surface of an insulating substrate 85 to the first and second connecting electrodes 96, 97 formed on a circuit substrate 95 via half through-holes 90, 91 provided in the first and second electrodes 81, 82. The protective element 80 thus constitutes a part of a current path between the first and second connecting electrodes 96, 97 formed on the circuit substrate 95. The half through-hole 90 of the protective element 80 is provided at a position offset from the center of the insulating substrate 85 so as to prevent accidental 180 degree misalignment in mounting of the protective element 80.

Since thermal runaway of a lithium ion secondary buttery, for example, might lead to a serious accident, it is required for this type of protective element to blow the meltable conductor as promptly as possible. When an abnormality such as an over-charging or over-discharging is detected, the protective element 80 must promptly blow the meltable conductor 83 to interrupt the current path; it is therefore required to preferentially conduct heat of the heat-generating element to the meltable conductor 83.

In cases of using a ceramic substrate having a high thermal conductivity as the insulating substrate 85 of the protective element 80, however, if the insulating substrate 85 is mounted at a tilted angle and a part of the corner portion contacts the circuit substrate 95, heat of the heat-generating element 84 will escape from the point contacting the circuit substrate 95. This leads to a disadvantage in reducing melting time because the heat of the heat-generating element 14 is not efficiently conducted to the meltable conductor 83.

An object of the present invention therefore is to provide a protective element capable of preventing this kind of partial contact of the insulating substrate and suppressing heat-dissipation of heat from the heat-generating element to improve the blowout property of the meltable conductor, and a protect circuit substrate using the same.

Solution to Problem

To solve the aforementioned problem, an aspect of the present invention is a protective element comprising: a rectangurarly shaped insulating substrate; a heat-generating element formed on the insulating substrate; an insulating member laminated on the insulating substrate for so as to cover at least the heat-generating element; a first and a second electrodes laminated on a surface of the insulating substrate; a first connecting terminal provided on a back surface of the insulating substrate and being continuous with the first electrode and a second connecting terminal provided on the back surface and being continuous with the second electrode; a heat-generating element extracting electrode provided on a current path between the first and the second electrodes and electrically connected to the heat-generating element; and a meltable conductor laminated on a region extending from the heat-generating element extracting electrode to the first and second electrodes and to be melted by heat to interrupt the current path between the first electrode and the second electrode; wherein at least one of the corner portions of the insulating substrate is chamfered.

Another aspect of the present invention is a protective circuit substrate having a circuit substrate and a protective element mounted on the circuit substrate, the protective element comprising: a rectangurarly shaped insulating substrate; a heat-generating element formed on the insulating substrate; an insulating member laminated on the insulating substrate for so as to cover at least the heat-generating element; a first and a second electrodes laminated on a surface of the insulating substrate; a first connecting terminal provided on a back surface of the insulating substrate and being continuous with the first electrode and a second connecting terminal provided on the back surface and being continuous with the second electrode; a heat-generating element extracting electrode provided on a current path between the first and the second electrodes and electrically connected to the heat-generating element; and a meltable conductor laminated on a region extending from the heat-generating element extracting electrode to the first and second electrodes and to be melted by heat to interrupt the current path between the first electrode and the second electrode; wherein at least one of the corner portions of the insulating substrate is chamfered.

Advantageous Effects of Invention

The present invention prevents partial contact of an insulating substrate to a circuit substrate even when the insulating substrate is mounted at a tilted angle by forming a chamfer on a corner portion. Thus, a protective element of this invention can suppress heat-dissipation from an insulating substrate and efficiently conduct heat of a heat-generating element to a meltable conductor to promptly blow the meltable conductor.

DESCRIPTION OF EMBODIMENTS

Figure 1A:
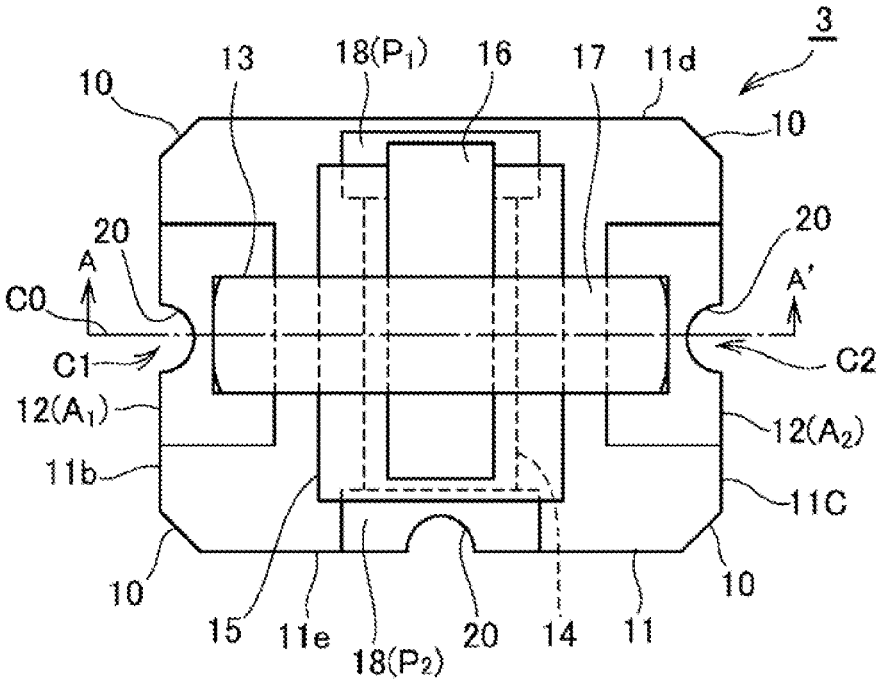
FIG. 1 (A) is a plan view illustrating a protective element of a protective circuit substrate according to an embodiment of the present invention and FIG. 1 (B) is an A-A' cross-sectional view of the protective circuit substrate.

Embodiments of a protective circuit substrate and a protective circuit substrate using the same according to the present invention will now be more particularly described with reference to the accompanying drawings. It should be noted that the present invention is not limited to the embodiments described below and various modifications can be added to the embodiment without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

Protective Circuit Substrate

Figure 1B:
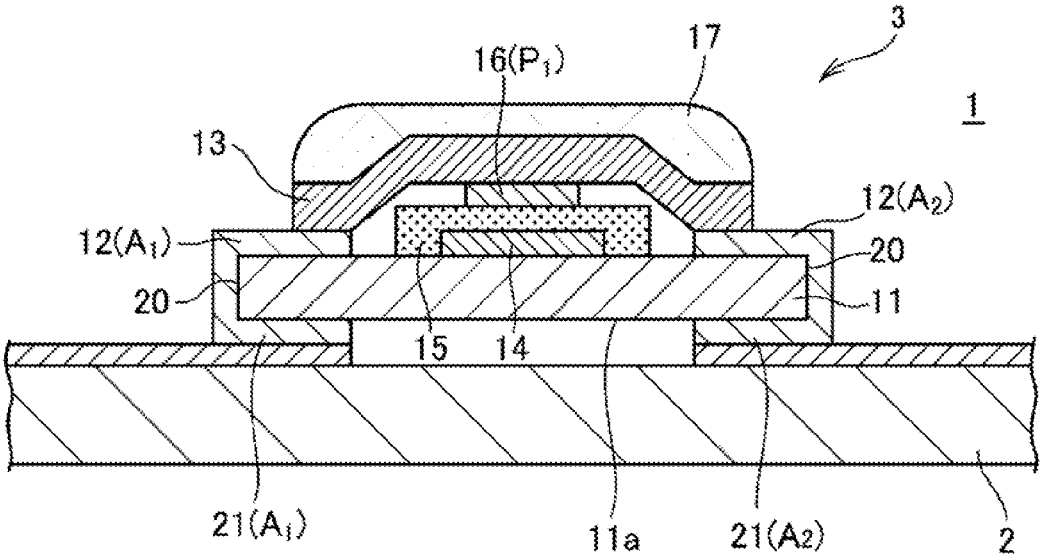

FIG. 1 shows a protective circuit substrate 1 according to the present invention including a circuit substrate 2 and a protective element 3 mounted on the circuit substrate 1. This protective circuit substrate 1 is incorporated in a battery pack of a lithium ion secondary battery to constitute a part of a current path, and when an abnormality such as over-charging and over-discharging is detected, blows a meltable conductor 13 of the protective element 3 to interrupt the current path.

Protective Element

As shown in FIG. 1 (A), the protective element 3 includes an insulating substrate 11, a heat-generating element 14 laminated on the insulating substrate 11 and covered with an insulating member 15, a first and a second electrodes 12 (A1), 12 (A2) formed on the both ends of the insulating substrate 11, a heat-generating element extracting electrode 16 laminated on the insulating member 15 and overlapping the heat-generating element 14, and a meltable conductor 13 the both ends of which are connected to the first and second electrodes 12 (A1), 12 (A2), respectively, and the central portion of which is connected to the heat-generating element extracting electrode 16.

The insulating substrate 11 is formed by using an insulating material such as alumina, glass ceramics, mullite and zirconia. Other materials used for printed circuit boards such as glass epoxy substrate or phenol substrate may be used as the insulating substrate 11; in these cases, however, the temperature at which the fuses are blown should be considered.

The insulating substrate 11 may be formed in an approximately rectangular shape as shown in FIG. 1 (A), for example. In addition, the insulating substrate 11 includes chamfers 10 formed on each corner portion thereof. The chamfer 10 is formed by chamfering the corner portions of the insulating substrate 11 in a linear or arc shape. The chamfer 10 is formed on at least one or preferably all of the corner portions of the insulating substrate 11.

Figure 2:
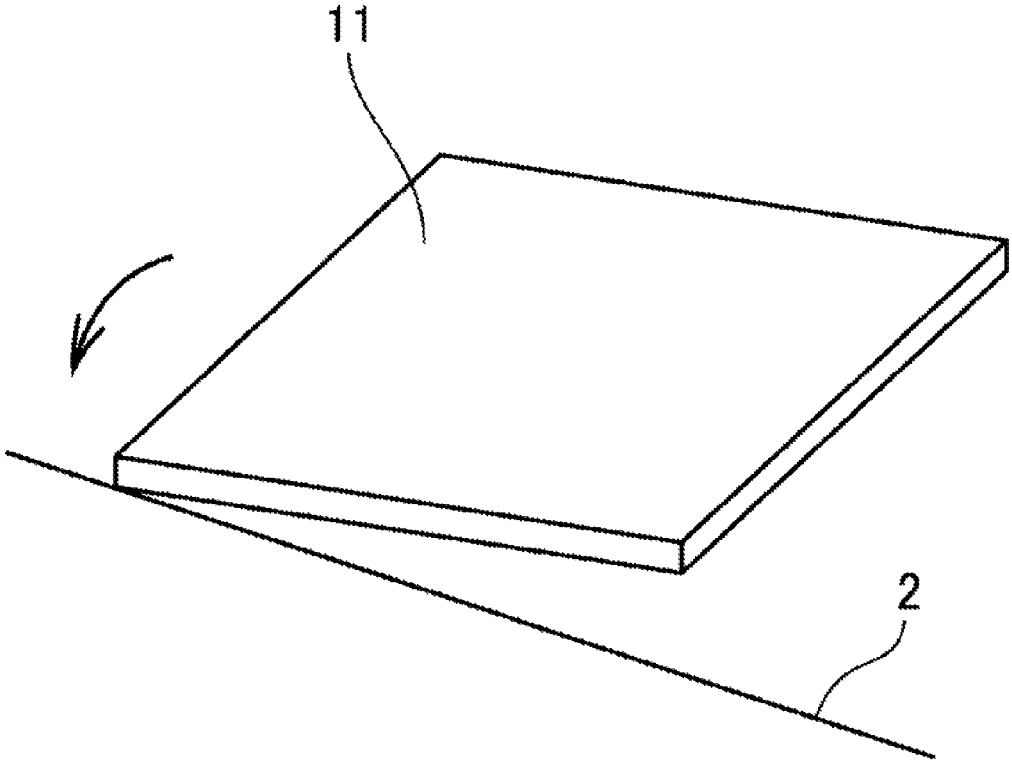
FIG. 2 illustrates partial contact of an insulating substrate.

The chamfer 10 formed on the protective element 3 will prevent partial contact caused by a tilted angle when mounting the protective element 3 onto circuit substrate 2, thus suppressing heat-dissipation. For example, as shown in FIG. 2, when mounting the protective element 3 onto the circuit substrate 2, partial contact might occur wherein a corner portion contacts the circuit substrate 2 because of inclination of the insulating substrate 11. In this case, if the insulating substrate is formed of a ceramic material having an excellent thermal-shock resistance but also having a high thermal conductivity, heat of the heat-generating element 14 is conducted to the circuit substrate 2 via the corner portion of the insulating substrate 11, as explained below, such that the temperature of the meltable conductor 13 cannot be efficiently raised.

Figure 3:
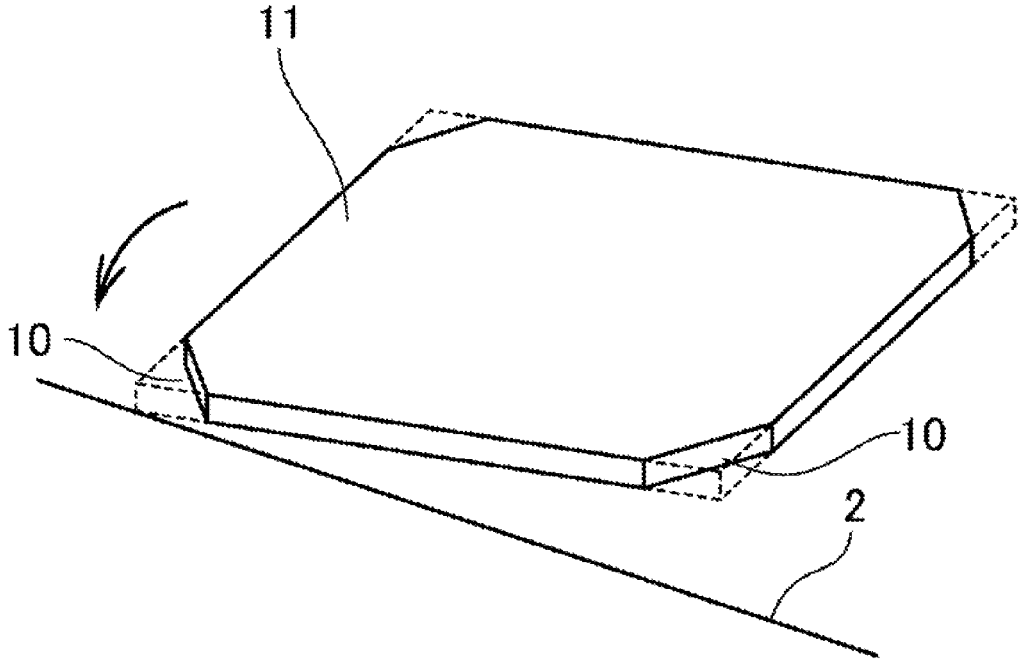
FIG. 3 illustrates a state in which a protective element according to an embodiment of the present invention is mounted at a tilted angle.

On the other hand, the protective element 3 can prevent this partial contact with the circuit substrate 2 even if the insulating substrate 11 is mounted at a tilted angle by forming a chamfer 10 on a corner portion of the insulating substrate 11 as shown in FIG. 3. The protective element 3 of this constitution can suppress heat-dissipation from the insulating substrate 11 and efficiently conduct heat of the heat-generating element 14 to the meltable conductor 13 to promptly blow the meltable conductor 13.

Figure 4:
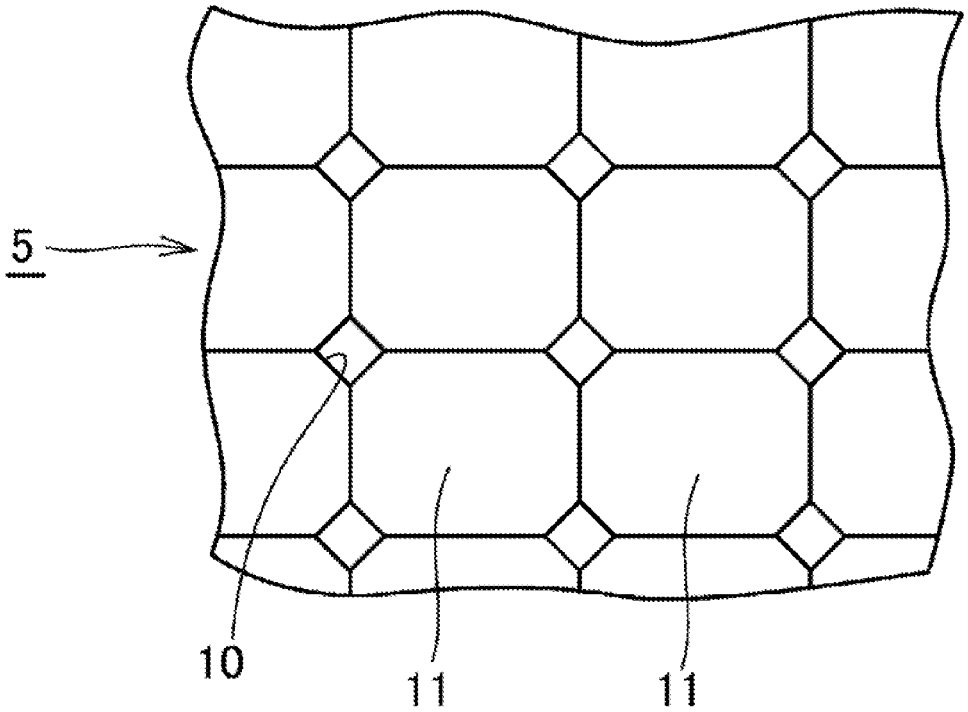
FIG. 4 is a plan view of a chamfered workpiece by punching.

The chamfer 10 can be formed by a punching process when cutting the insulating substrate 11 out of a workpiece into a predetermined product size. For example, as shown in FIG. 4, the chamfer 10 can be formed by punching out a rectangular or circular shape from adjacent corner portions of mutually adjoining insulating substrates 11 arranged in a matrix in a workpiece 5. In addition, the chamfer 10 may be formed when press-forming the insulating substrate 11. Alternatively, the chamfer 10 may be formed by machining the insulating substrate 11.

Figure 5:
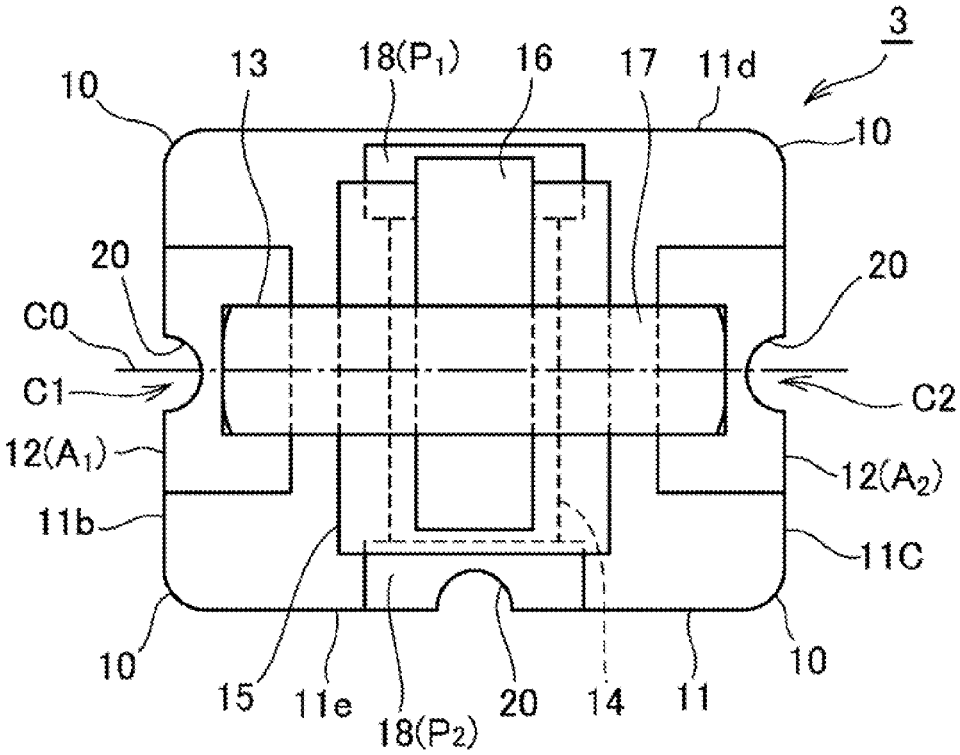
FIG. 5 is a plan view illustrating a protective element according to an alternative embodiment of the present invention.

Furthermore, the chamfer 10 may be formed in a linear shape as shown in FIG. 1 or in an arc shape as shown in FIG. 5.

The heat-generating element 14 is made of a conductive material such as W, Mo and Ru, which has a relatively high resistance and generates a heat when a current flows therethrough. A powdered alloy, composition or compound of these materials is mixed with resin binder to obtain a paste, which is screen-printed as a pattern on the insulating substrate 11 and baked to form the heat-generating element 14.

The insulating member 15 is arranged such that it covers the heat-generating element 14, and the heat-generating element extracting electrode 16 is disposed so as to face the heat-generating element 14 via this insulating member 15. The insulating member 15 may be laminated between the heat-generating element 14 and the insulating substrate 11 so as to efficiently conduct the heat of the heat-generating element 14 to the meltable conductor 13. The insulating member 15 may be made of a glass.

One end of the heat-generating element extracting electrode 16 is connected to the heat-generating element electrode 18 (P1) and is continuous with one end of the heat-generating element 14. The other end of the heat-generating element 14 is connected to the other heat-generating element electrode 18 (P2). It should be noted that the heat-generating element electrode 18 (P1) is formed at the side of a third edge 11*d* of the insulating substrate 11 and the heat-generating element electrode 18 (P2) is formed at the side of a fourth edge 11*e* of the insulating substrate 11. In addition, as shown in FIG. 6, the heat-generating element electrode 18 (P2) is connected to the external connecting electrode 21 (P2) formed on the back surface 11*a* of the insulating substrate 11 via a half through-hole 20 formed at the fourth edge 11*e*.

The meltable conductor 13 is formed from a low melting point metal, such as Pb free solder consisting essentially of Sn, capable of being promptly melted by a heat of the heat-generating element 14. In addition, the meltable conductor 13 may be formed by using a high melting point metal such as In, Pb, Ag, Cu or an alloy consisting essentially of any one of these, or may have a laminated structure of a low melting point metal and a high melting point metal.

It should be noted that the meltable conductor 13 is connected to the heat-generating element extracting electrode 16 and the electrodes 12 (A1), 12 (A2) by soldering, for example. The meltable conductor 13 can be easily connected by reflow soldering.

Figure 6:
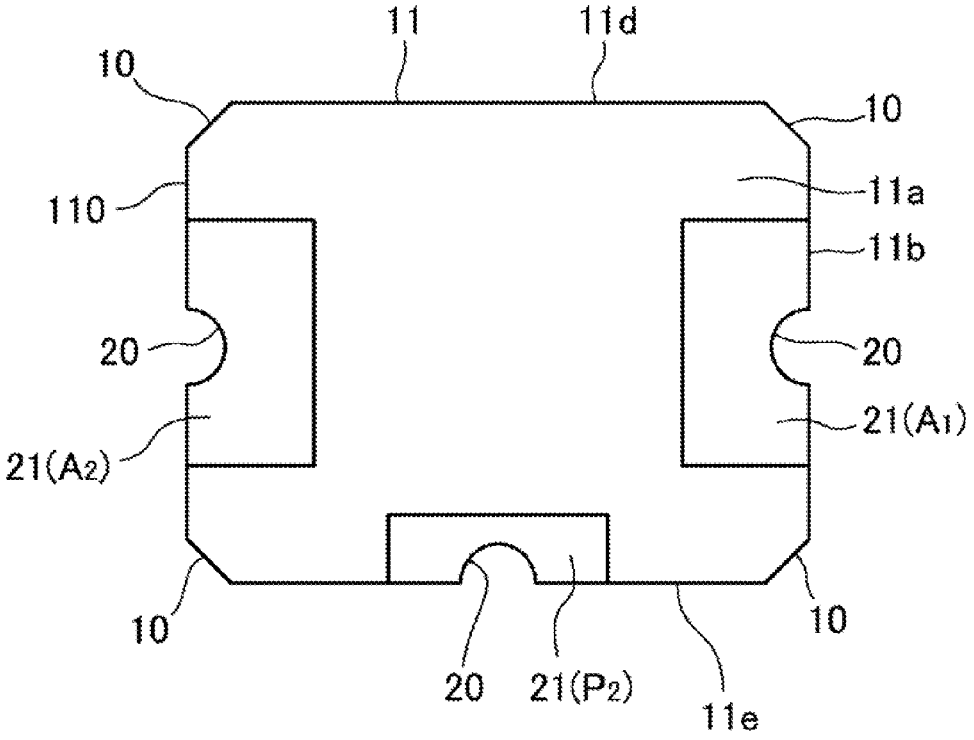
FIG. 6 is a rear view of the protective element.

As shown in FIG. 6, the first electrode 12 (A1) and the second electrode 12 (A2) formed on the both side edges of the insulating substrate 11 and connected by the meltable conductor 13 are connected to a first and a second external connecting terminals 21 (A1), 21 (A2) formed in the back surface 11*a* of the insulating substrate 11 via the half through-hole 20, respectively. The protective element 3 is incorporated as a part of a current path by connecting the external connecting terminals 21 (A1), 21 (A2) to connecting electrodes 25 (A1), 25 (A2) provided on the circuit substrate 2 as described below.

The half through-holes 20, having a conductive layer on the inner wall thereof, electrically connect the first electrode 12 (A1) to the first external connecting terminals 21 (A1), and the second electrode 12 (A2) to the second external connecting terminals 21 (A2). The half through-holes 20 are formed at the first edge 11*b* of the insulating substrate 11 on which the first electrode 12 (A1) is formed, and the second edge 11*c* on which the second electrode 12 (A2) is formed. The conductive layer on the inner wall of the half through-hole 20 can be formed by filling a conductive paste therein.

The first electrode 12 (A1) is provided at the edge portion of the first edge 11*b* of the insulating substrate 11 formed in a rectangular shape. In addition, the first electrode 12 (A1) is placed at an inner position relative to the chamfers 10 formed on the both ends of the first edge 11*b* of the insulating substrate 11. This constitution of the protective element 3 can separate the first electrode 12 (A1) from the outer edge of the insulating substrate 11 as far as possible, and can prevent the heat generated by the heat-generating element 14 from conducting to the circuit substrate 2 via the first electrode 12 (A1) or to the surroundings, thus improving the high-speed blowout property of the meltable conductor 13.

Thus, the heat generated by the heat-generating element 14 is also conducted to the first electrode 12 (A1) via the meltable conductor 13 and is also dissipated from the first electrode 12 (A1). It is necessary for the protective element 3 to promptly blow the meltable conductor 13 and interrupt the current path when an abnormality occurs in an electronic appliance, and it is therefore required to suppress dissipation of the heat of the heat-generating element 14 from the first electrode 12 (A1) so as to raise the temperature of the meltable conductor 13 to the melting temperature thereof. Since a large part of the heat of the first electrode 12 (A1) is dissipated from the outer edge of the insulating substrate 11, the first electrode 12 (A1) of the protective element 3 is placed at an inner position relative to the both ends of the first edge 11*b* of the insulating substrate 11 so as to separate the first electrode 12 (A1) from the outer edge of the insulating substrate 11 as far as possible. This constitution of the protective element 3 can prevent the heat generated by the heat-generating element 14 from being conducted to the circuit substrate 2 via the first electrode 12 (A1) or dissipated to the surroundings.

In addition, the first electrode 12 (A1) may be placed around the central portion C1 of this first edge 11*b* of the insulating substrate 1. Thus, the electrode area of the first electrode 12 (A1) can be made small such that heat capacity is reduced, and the heat dissipating path is restricted to the half through-hole 20, thereby further suppressing the heat-dissipation from the first electrode 12 (A1).

Through-Hole

The half through-hole 20 connecting the first electrode 12 (A1) to the first external connecting terminals 21 (A1) is formed at the central portion C1 of the first edge 11*b* of the insulating substrate 11. Compared to the constitution in which the half through-hole 20 is offset towards one side of the first edge 11*b* (see FIG. 19), this constitution can make the heat dissipating path shorter and prevent the heat of the heat-generating element 14 from spreading to the first electrode 12 (A1), thus efficiently concentrating the heat of the heat-generating element 14 into the meltable conductor 13.

In the protective element 3, the substrate center, which is farthest from the outer edge of the insulating substrate 11 and from which heat from the heat-generating element 14 escapes least, attains the highest temperature. In accordance with this substrate center, by forming the through-hole 20 at the central portion C1 of the first edge 11*b* of the insulating substrate 11, the heat dissipating path is not spread to the first electrode 12 (A1) or the first edge 11*b* on which the first electrode 12 (A1) is formed, thus enabling concentration of the heat of the heat-generating element 14 into the meltable conductor 13.

In this situation, as described above, by also forming the first electrode 12 (A1) at the central portion C1 of the first edge 11*b* of the insulating substrate 11, the heat capacity of the first electrode 12 (A1) can be suppressed and dissipation of the heat spread to the first electrode 12 (A1) is also suppressed, thereby reducing the heat-dissipation from the heat-generating element 14.

Explanation of the first electrode 12 (A1) described above is also applicable to the second electrode 12 (A2). Consequently, the second electrode 12 (A2) is placed at an inner position relative to the chamfers 10 on the both ends of the second edge 11*c* of the insulating substrate 11, and preferably around a central portion C2 of this second edge 11*c* of the insulating substrate 11.

This constitution of the second electrode 12 (A2) can prevent the heat generated by the heat-generating element 14 from conducting to the circuit substrate 2 via the second electrode 12 (A2) or to the surroundings, thus improving the high-speed blowout property of the meltable conductor 13, and the heat dissipating path is restricted to the half through-hole 20, thereby further suppressing the heat-dissipation from the second electrode 12 (A2).

Similarly, the half through-hole 20 provided to the second electrode 12 (A2) is also formed at the central portion C2 of the second edge 11*c* of the insulating substrate 11. Compared to the constitution in which the half through-hole 20 is offset towards one side of the first edge 1, this constitution can make the heat dissipating path shorter and prevent the heat of the heat-generating element 14 from spreading to the second electrode 12 (A2), thus efficiently concentrating the heat of the heat-generating element 14 into the meltable conductor 13.

Position of Meltable Conductor

In addition, the meltable conductor 13 is preferably provided on the center line C0 of the insulating substrate 1 connecting the respective central portions C1, C2 of the first edge 11*b* and the second edge 11*c* of the insulating substrate 11. The meltable conductor 13 is thus placed on the central region of the insulating substrate 11 which will be heated to the highest temperature, and the heat of the heat-generating element is efficiently conducted to and promptly blows the meltable conductor 13.

It should be noted that the meltable conductor 13 may be offset from the center line C0 of the insulating substrate 11 as long as it is connected between the first and second electrodes 12 (A1), 12 (A2). In this case, heat-dissipation from the first electrode 12 (A1) and the second electrode 12 (A2) is also suppressed and the meltable conductor 13 is efficiently heated by the heat of the heat-generating element 14 and promptly blown. In addition, multiple meltable conductors 13 may be provided between the first and second electrodes 12 (A1), 12 (A2), and one of these meltable conductors 13 may be placed on the center line C0 of the insulating substrate 11, or all of the meltable conductors 13 may be offset from the center line C0 of the insulating substrate 11.

It should be noted that a flux 17 may be applied on almost the entire surface of the meltable conductor 13 of the protective element 3 in order to prevent oxidation of the meltable conductor 13.

Moreover, the protective element 3 may include a covering member (not shown) over the insulating substrate 11 for internal protection.

Circuit Substrate

Figure 7:
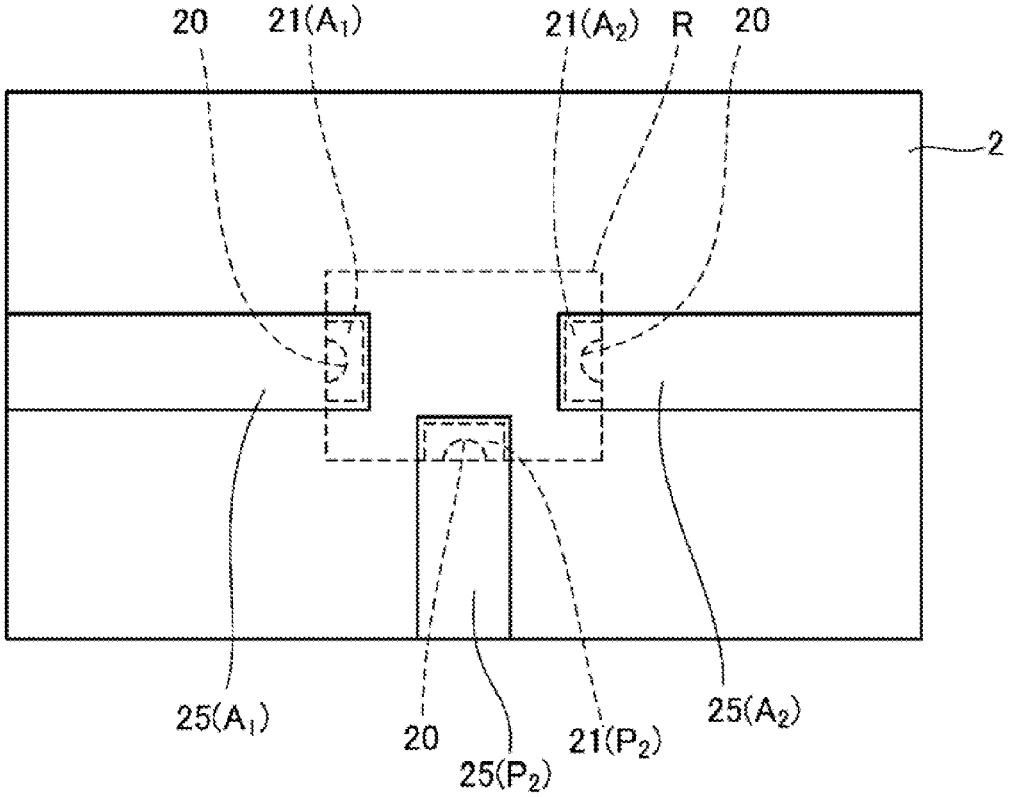
FIG. 7 is a plan view illustrating a circuit substrate of a protective circuit substrate according to an embodiment of the present invention.

Next, the circuit substrate 2 to which the protective element 3 is connected will be explained. The circuit substrate 2 may be any conventional insulating substrate including a glass epoxy substrate or a glass substrate, a rigid substrate such as a ceramics substrate, and a flexible substrate having a mounting region R onto which the protective element 3 is mounted, as shown in FIG. 7, and connecting electrodes for connecting to the protective element 3 are provided in the mounting region R. The mounting region R has a shape and area approximately the same as those of the insulating substrate 11 of the protective element 3. It should be noted that, an element such as an FET is mounted to the circuit substrate 2 for providing current to the heat-generating element 14 of the protective element 3.

The mounting region R has the same area as the insulating substrate 11 of the protective element 3, and connecting electrodes 25 (A1), 25 (A2) and 25 (P2) connected respectively to external connecting terminals 21 (A1), 21 (A2) and 21 (P2) formed on a back surface 11*a* of the insulating substrate 11 are formed in the mounting region R. In addition, except for the connecting electrodes 25 (A1), 25 (A2) and 25 (P2) necessary for connection to the protective element 3, no other electrode pattern unnecessary for connection to the protective element 3 is formed in the mounting region R.

Since the mounting region R constituted as above includes an electrode pattern having a large heat capacity to the extent necessary for mounting the protective element 3, heat-dissipation from the back surface 11*a* of the insulating substrate 11 can be suppressed. The protective circuit substrate 1 therefore can efficiently conduct the heat of the heat-generating element 14 to the meltable conductor 13. Consequently, the protective circuit substrate 1 can promptly blow the meltable conductor 13 to interrupt the current path when an abnormality such as over-charging and over-discharging is detected.

The connecting electrodes 25 (A1), 25 (A2) have a width wider than that of the external connecting terminals 21 (A1), 21 (A2), thus reducing the contact resistance with the protective element 3. However, wide connecting electrodes 25 (A1), 25 (A2) provided in the mounting region R of the protective element 3 will absorb heat from the heat-generating element 14 to inhibit prompt melting of the meltable conductor 13. In view of the above, the connecting electrodes 25 (A1), 25 (A2) are preferably formed to a width approximately the same as that of the external connecting terminals 21 (A1), 21 (A2).

Method of Using Protective Circuit Substrate

Next, a method of using the protective circuit substrate 1 will be explained.

Figure 8:
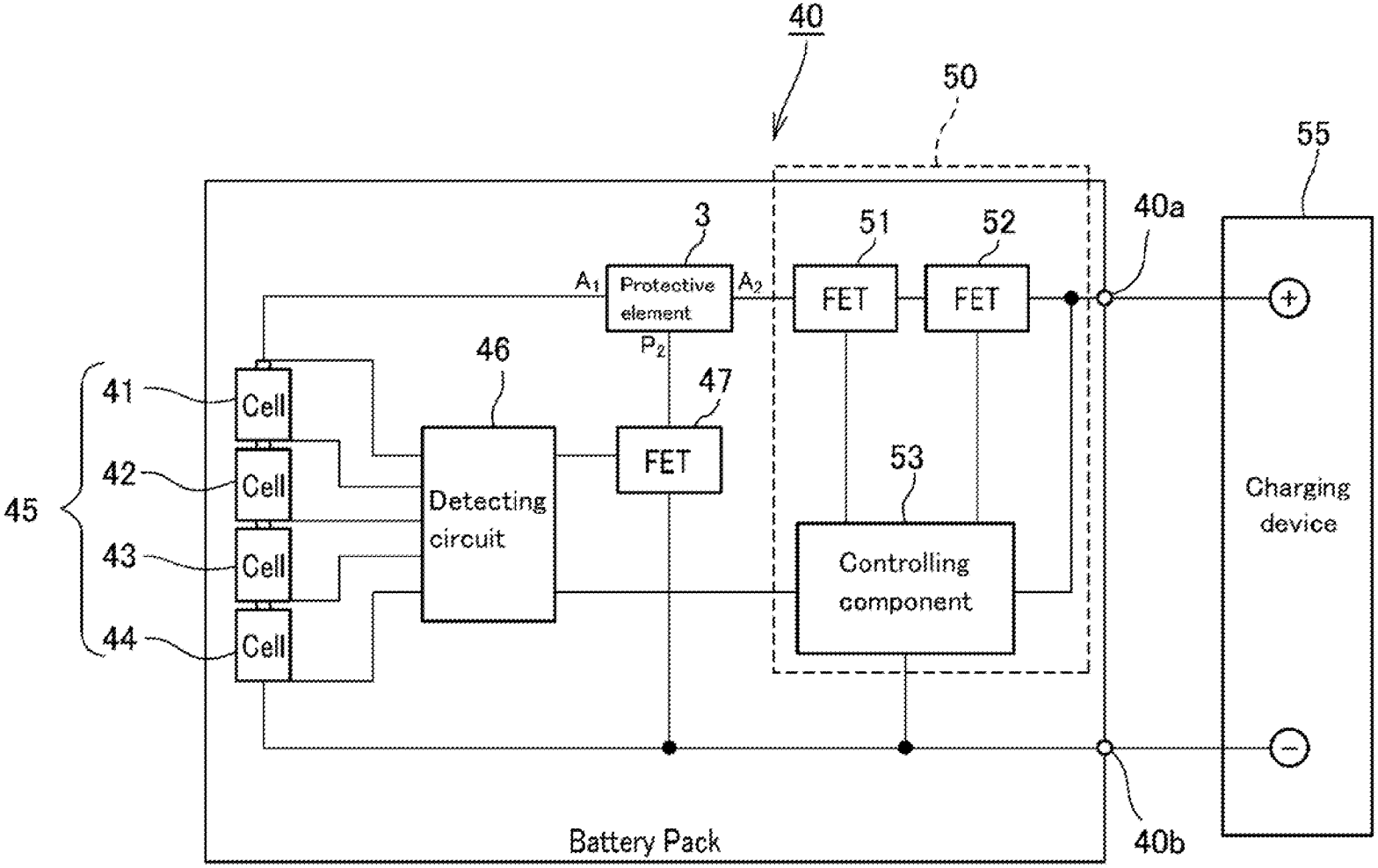
FIG. 8 is a circuit diagram of a battery pack.

The above-described protective circuit substrate 1 is used as, for example, a circuit within a battery pack of a lithium ion secondary battery as shown in FIG. 8.

For example, the protective element 3 is incorporated in a battery pack 40 including a battery stack 45 comprising four battery cells 41 to 44 in total in a lithium ion secondary battery.

The battery pack 40 includes: a battery stack 45: a charging/discharging controlling circuit 50 for controlling charging/discharging of the battery stack 45; a protective element 3 according to the present invention for interrupting charging when an abnormality is detected in the battery stack 45; a detection circuit 46 for detecting a voltage of each battery cell 41 to 44; and a current controlling element 47 for controlling the operation of the protective element 3 in accordance with the detection result of the detection circuit 46.

The battery stack 45, comprising battery cells 41 to 44 connected in series and requiring a control for protection from over-charging or over-discharging state, is removably connected to a charging device 55 via an anode terminal 40*a* and a cathode terminal 40*b* of the battery pack 40, and the charging device 55 applies charging voltage to the battery stack 45. The battery pack 40 charged by the charging device 55 can be connected to a battery-driven electronic appliance via the anode terminal 40*a* and the cathode terminal 40*b* and supply electric power to the electronic appliance.

The charging/discharging controlling circuit 50 includes the two current controlling elements 51, 52 connected to the current path from the battery stack 45 to the charging device 55 in series, and the controlling component 53 for controlling the operation of these current controlling elements 51, 52. The current controlling elements 51, 52 are formed of a field effect transistor (hereinafter referred to as FET) and the controlling component 53 controls the gate voltage to switch the current path of the battery stack 45 between a conducting state and an interrupted state. The controlling component 53 is powered by the charging device 55 and, in accordance with the detection signal from the detecting circuit 46, controls the operation of the current controlling elements 51, 52 to interrupt the current path when over-discharging or over-charging occurs in the battery stack 45.

The protective element 3 is connected in a charging/discharging current path between the battery stack 45 and the charging/discharging controlling circuit 50, for example, and the operation thereof is controlled by the current controlling element 47.

The detecting circuit 46 is connected to each battery cell 41 to 44 to detect voltage value of each battery cell 41 to 44 and supplies the detected voltage value to a controlling component 53 of the charging/discharging controlling circuit 50. Furthermore, when an over-changing voltage or over-discharging voltage is detected in one of the battery cells 41 to 44, the detecting circuit 46 outputs a control signal for controlling the current controlling elements 47.

When the detection signal output from the detection circuit 46 indicates a voltage exceeding the predetermined threshold value corresponding to over-discharging or over-charging of the battery cells 41 to 44, the current controlling element 47, which is formed of an FET, for example, activates the protective element 3 to interrupt the charging/discharging current path of the battery stack 45 without the switching operation of the current controlling element 51, 52.

Particular arrangement of the protective element 3 in the battery pack 40 constituted as above will be explained below.

Figure 9:
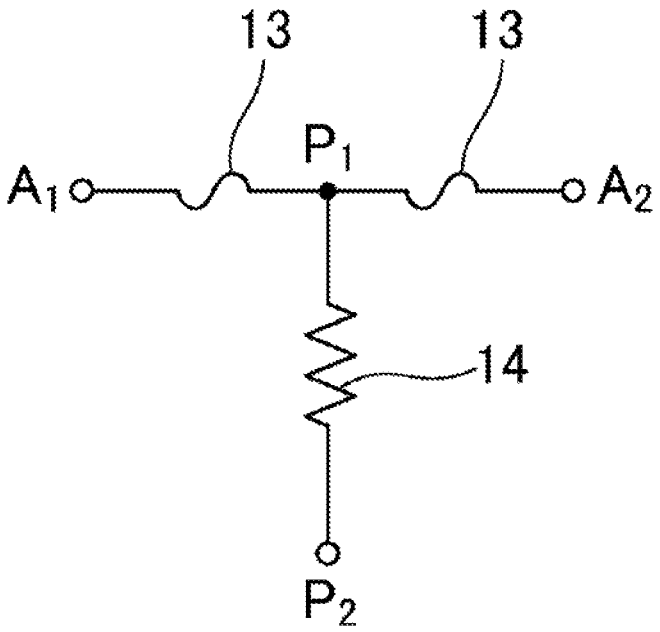
FIG. 9 is a circuit diagram of a protective element.
Figure 10A:
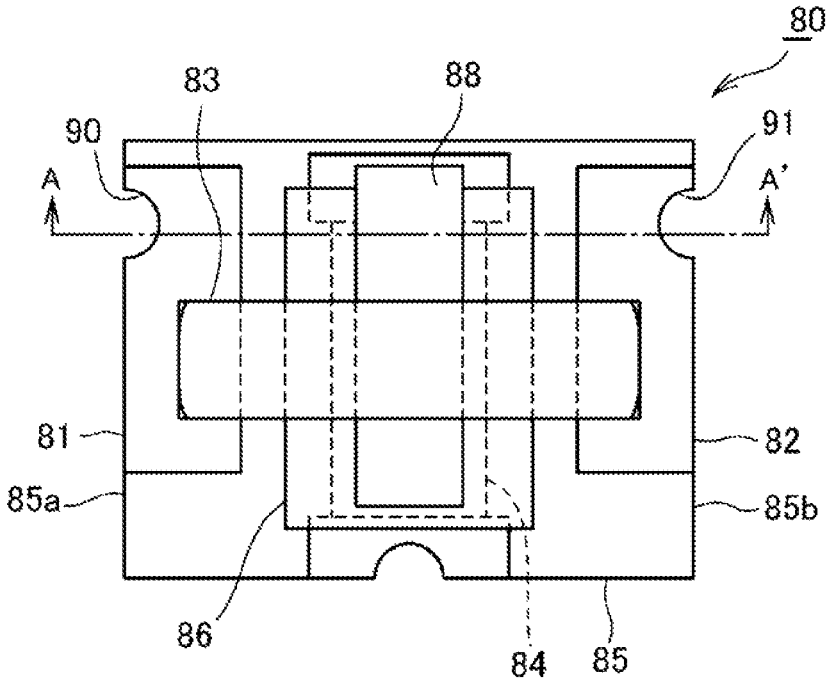
FIG. 10 (A) is a plan view illustrating a protective element of a protective circuit substrate of a Reference example and FIG. 10 (B) is a cross-sectional view of the protective circuit substrate.
Figure 10B:
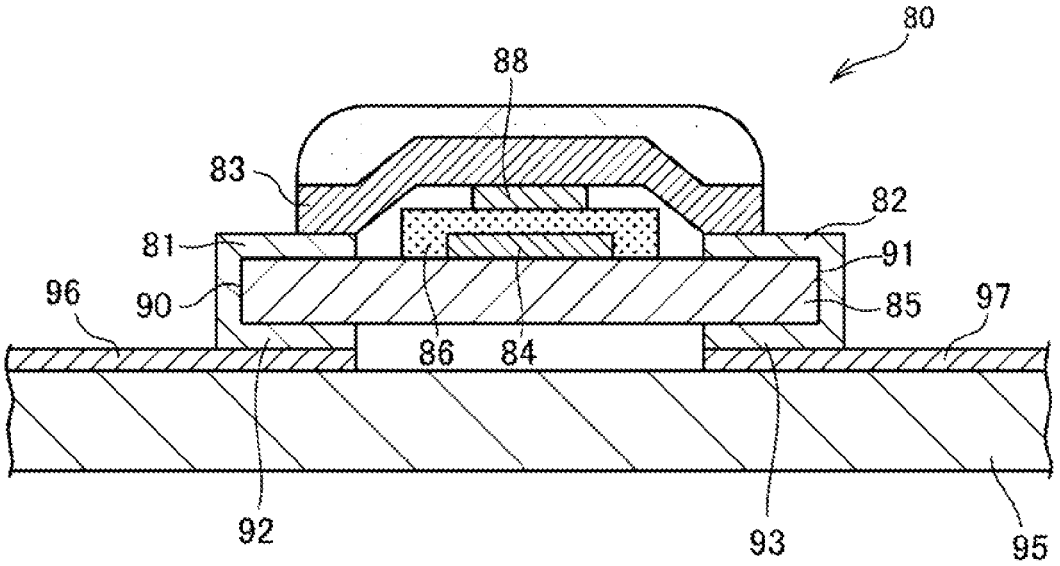

FIG. 9 shows an illustrative circuit arrangement of the protective element 3 according to the present invention. As shown, the protective element 3 includes a meltable conductor 13 connected in series via the heat-generating element extracting electrode 16 and a heat-generating element 14 through which a current flows via a connecting point to the meltable conductor 13 and which generates heat to melt the meltable conductor 13. Furthermore, in the protective element 3, the meltable conductor 13 is directly connected in the charging/discharging current path and the heat-generating element 14 is serially connected to the current controlling element 47. The protective element 3 includes two electrodes 12, one being connected to A1 and the other being connected to A2, via the external connecting terminal 21, respectively. In addition, the heat-generating element extracting electrode 16 and the heat-generating element electrode 18 connected thereto are connected to P1 and the other heat-generating element electrode 18 is connected to P2 via the external connecting terminal 21.

In the protective element 3 having this circuit arrangement, the meltable conductor 13 in the current path can be certainly blown by the heat generated by the heat-generating element 14. Moreover, since a chamfer 10 is formed on a corner portion of the insulating substrate 11, the protective element 3 can prevent partial contact with the circuit substrate 2 even if the insulating substrate 11 is mounted at a tilted angle. The protective element 3 of this constitution can suppress heat-dissipation from the insulating substrate 11 and efficiently conduct heat of the heat-generating element 14 to the meltable conductor 13 to promptly blow the meltable conductor 13.

Those skilled in the art will appreciate that the protective element according to the present invention is not limited to usage in battery packs of lithium ion secondary batteries but may be applied to any other application requiring interruption of a current path by an electric signal.

REFERENCE SIGNS LIST

1 protective circuit substrate, 2 circuit substrate, 3 protective element, 5 workpiece, 10 chamfer, 11 insulating substrate, 11*a* back surface, 11*b* first edge, 11*c* second edge, 11*d* third edge, 12 electrode, 13 meltable conductor, 14 heat-generating element, 15 insulating member, 16 heat-generating element extracting electrode, 17 flux, 18 heat-generating element electrode, 20 half through-hole, 21 external connecting terminal, 25 connecting electrode, 40 battery pack, 41 to 44 battery cell, 45 battery stack, 46 detection circuit, 47 current controlling element, 50 charging/discharging controlling circuit, 51, 52 current controlling element, 53 controlling unit, 55 charging device

The invention claimed is:

1. A protective element comprising:

a rectangurarly shaped insulating substrate;

a heat-generating element formed on the insulating substrate;

an insulating member laminated on the insulating substrate for so as to cover at least the heat-generating element;

a first and a second electrodes laminated on a surface of the insulating substrate;

a first connecting terminal provided on a back surface of the insulating substrate and being continuous with the first electrode and a second connecting terminal provided on the back surface and being continuous with the second electrode;

a heat-generating element extracting electrode provided on a current path between the first and the second electrodes and electrically connected to the heat-generating element; and a meltable conductor laminated on a region extending from the heat-generating element extracting electrode to the first and second electrodes and to be melted by heat to interrupt the current path between the first electrode and the second electrode;

wherein at least one of the corner portions of the insulating substrate is chamfered.

2. The protective element according to claim 1, wherein the corner portion is chamfered in a linear shape or in an arc shape.

3. The protective element according to claim 2, wherein the insulating substrate is chamfered by punching out the corner portion.

4. The protective element according to claim 1, wherein the insulating substrate is chamfered by punching out the corner portion.

5. The protective element according to claim 1, wherein the insulating substrate is a ceramic substrate.

6. The protective element according to claim 1, wherein all of the corner portions are chamfered.

7. The protective element according to claim 6, wherein the corner portion is chamfered in a linear shape or in an arc shape.

8. The protective element according to claim 6, wherein the insulating substrate is chamfered by punching out the corner portion.

9. A protective circuit substrate having a circuit substrate and a protective element mounted on the circuit substrate, the protective element comprising:

a rectangurarly shaped insulating substrate;

a heat-generating element formed on the insulating substrate;

an insulating member laminated on the insulating substrate for so as to cover at least the heat-generating element;

a first and a second electrodes laminated on a surface of the insulating substrate;

a first connecting terminal provided on a back surface of the insulating substrate and being continuous with the first electrode and a second connecting terminal provided on the back surface and being continuous with the second electrode;

a heat-generating element extracting electrode provided on a current path between the first and the second electrodes and electrically connected to the heat-generating element; and a meltable conductor laminated on a region extending from the heat-generating element extracting electrode to the first and second electrodes and to be melted by heat to interrupt the current path between the first electrode and the second electrode;

wherein at least one of the corner portions of the insulating substrate is chamfered.

* * * * *